US006975069B2

(12) United States Patent
Crandall

(10) Patent No.: US 6,975,069 B2
(45) Date of Patent: Dec. 13, 2005

(54) MULTI-PHASE GAS DISCHARGE LAMPS

(75) Inventor: Earl F. Crandall, Raleigh, NC (US)

(73) Assignee: Transworld Lighting, Inc., Savannah, GA (US)

( * ) Notice: Subject to any disclaimer, the term of this patent is extended or adjusted under 35 U.S.C. 154(b) by 0 days.

(21) Appl. No.: 10/817,708

(22) Filed: Apr. 2, 2004

(65) Prior Publication Data

US 2004/0195953 A1 Oct. 7, 2004

Related U.S. Application Data

(60) Provisional application No. 60/460,380, filed on Apr. 4, 2003.

(51) Int. Cl.[7] ..... H01J 17/49
(52) U.S. Cl. ..... 313/582; 313/493; 313/634
(58) Field of Search ..... 313/493, 582, 313/620, 634, 637; 315/169.4

(56) References Cited

U.S. PATENT DOCUMENTS

| | | | | |
|---|---|---|---|---|
| 3,681,654 A | | 8/1972 | Quinn | |
| 4,912,364 A | * | 3/1990 | Hollo et al. | 313/623 |
| 5,343,116 A | * | 8/1994 | Winsor | 313/493 |
| 5,615,093 A | | 3/1997 | Nalbant | |

FOREIGN PATENT DOCUMENTS

WO 03/019992 A1 3/2003

* cited by examiner

*Primary Examiner*—Vip Patel
(74) *Attorney, Agent, or Firm*—Buchanan Ingersoll PC

(57) ABSTRACT

A multi-phase gas discharge lamp includes an interior space defined by at least one wall. A plasma-forming gas is disposed in the interior space. At least three electrodes are positioned to access the interior space, each electrode adapted to receive one phase of a multi-phase AC power source and energize the plasma-forming gas in response. The multi-phase energization of a plasma-forming gas maintains the energy level in the plasma, which maximizes efficiency of a gas discharge lamp.

14 Claims, 13 Drawing Sheets

DUAL CHAMBER MULTI-PHASE LAMP

FIGURE 10. DUAL CHAMBER MULTI-PHASE LAMP

FIGURE 11. DUAL CHAMBER MULTI-PHASE LAMP

MULTI-PHASE GAS DISCHARGE LAMPS

RELATED APPLICATIONS

This application claims priority under 37 C.F.R. § 119 to provisional application Ser. No. 60/460,380 filed on Apr. 4, 2003, entitled "Multi-Phase Gas Discharge Lamps," which is incorporated by reference herein in its entirety.

BACKGROUND

The present invention relates generally to gas discharge lamps. More specifically, this invention relates to multi-phase gas discharge lamps configured to maintain the plasma within the lamp at a desired level of energization.

SUMMARY

Multi-phase energization of a plasma-forming gas maintains the energy level in the plasma, which maximizes efficiency of a gas discharge lamp.

In one aspect of the invention, a multi-phase gas discharge lamp includes an interior space defined by at least one wall. A plasma-forming gas is disposed in the interior space. At least three electrodes are positioned to access the interior space, each electrode adapted to receive one phase of a multi-phase AC power source and energize the plasma-forming gas in response.

BRIEF DESCRIPTION OF THE DRAWINGS

Objects and advantages of the present invention will become apparent to those skilled in the art upon reading this description in conjunction with the accompanying drawings, in which like reference numerals have been used to designate like elements, and in which.

DETAILED DESCRIPTION

Figure 1:
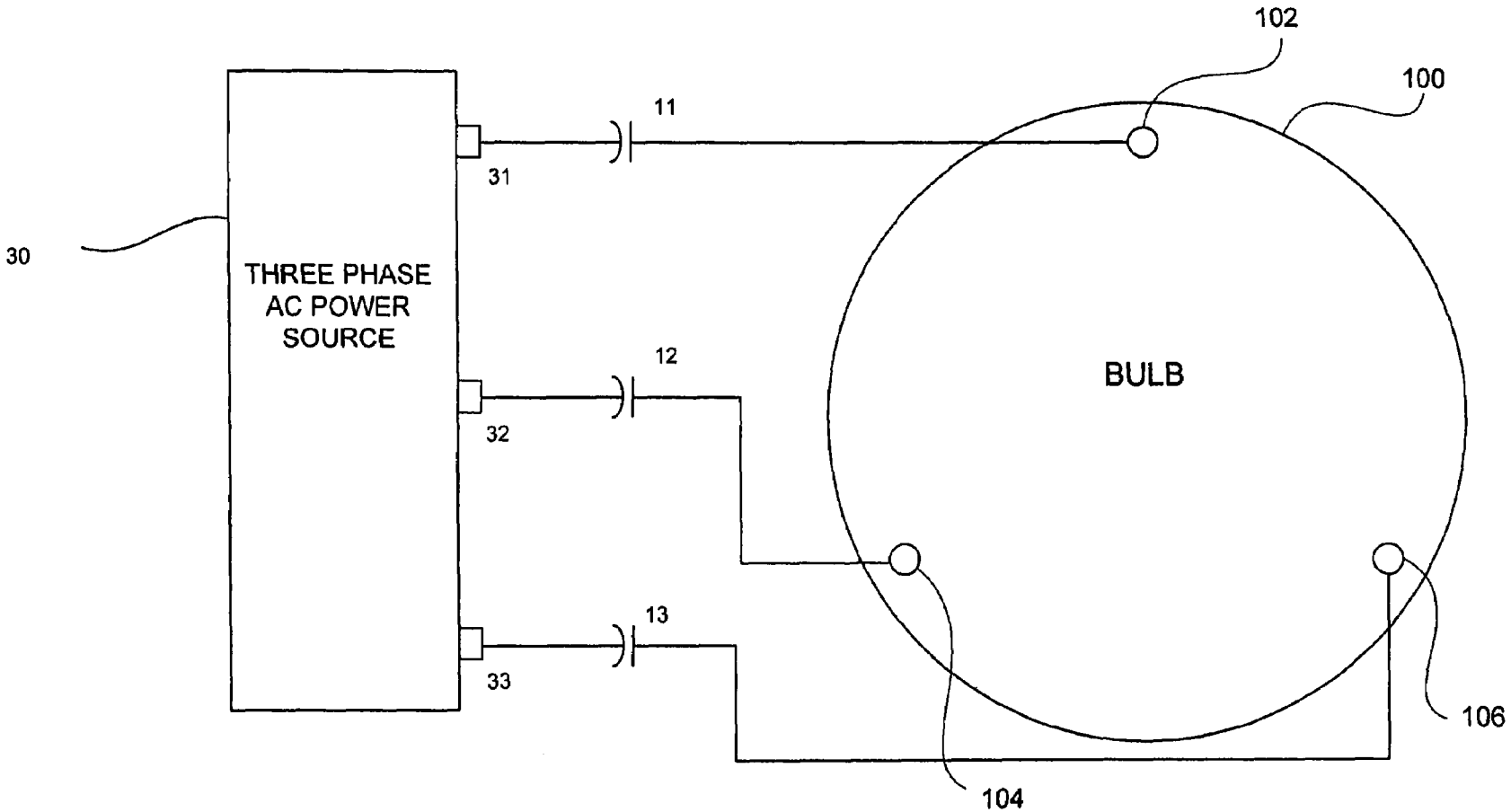
FIG. 1 is a schematic representation of a multi-phase gas discharge lamp system according to an embodiment of the present invention.

Fluorescent lamps operate by creating an electrical discharge through a gas mixture contained within a glass tube. The traditional fluorescent—or gas discharge—lamp comprises a tube containing an inert gas and a material such as mercury vapor which, emits UV photons when excited by collisions with electrons of the current flow through the lamp. These photons strike fluorescent material on the inner wall of the glass tube and produce visible light.

Fluorescent lamps require a ballast to control operation. The ballast conditions the electric power to produce the input characteristics needed for the lamp. When conducting, the lamp exhibits a negative resistance characteristic, and therefore needs some control to avoid a cascading discharge. Both manufacturers and the American National Standards Institute specify lamp characteristics, which include current, voltage, and starting conditions. Historically, 50–60 Hz ballasts relied on a heavy core of magnetic material; today, most modern ballasts are electronic.

Electronic ballasts can include a starting circuit and may or may not require heating of the lamp electrodes for starting or igniting the lamp. Prior to ignition, a lamp acts as an open circuit; after the lamp starts, it behaves like a conductor and the entire ballast starting voltage is applied to the lamp. After ignition, the current through the lamp increases until the lamp voltage reaches equilibrium based on the ballast circuit. Ballasts can also have additional circuitry designed to filter electromagnetic interference (EMI), correct power factor errors for alternating current power sources, filter noise, etc.

Electronic ballasts typically use a rectifier and an oscillating circuit to create a pulsed flow of electricity to the lamp. Common electronic lighting ballasts convert 60 Hz line or input current into a direct current, and then back to a square wave alternating current to operate lamps near frequencies of 20–40 kHz. Some lighting ballasts further convert the square wave to more of a sine wave, typically through an LC resonant lamp network to smooth out the pulses to create sinusoidal waveforms for the lamp. See, for example, U.S. Pat. No. 3,681,654 to Quinn, or U.S. Pat. No. 5,615,093 to Nalbant.

The square wave approach is common for a number of reasons. Many discrete or saturated switches are better suited to the production of a square wave than a sinusoidal wave. In lower frequency applications, a square wave provides more consistent lighting; a normal sinusoid at low frequency risks de-ionization of the gas as the voltage cycles below the discharge level. A square wave provides a number of other features, such as constant instantaneous lamp power, and favorable crest factors. With a square wave, current density in the lamp is generally stable, promoting long lamp life; similarly, there is little temperature fluctuation, which avoids flicker and discharge, damaging the lamp.

In general, energy can be saved by avoiding the cycle of decay and recovery of ionization within the lamp. It is thus desirable to minimize the de-ionization of the gas during the oscillatory application of power to the electrodes. One way to accomplish this is through the use of higher frequencies, which can be accomplished, for example, in the manner described in PCT Publication No. WO 03/019992, in order to minimize the effects of harmonic distortion.

The present invention contemplates another approach to minimizing de-ionization of the gas in a fluorescent lamp. According to this approach, a gas discharge lamp is configured with three or more electrodes, each supplied by a different phase output line from the lamp driver/oscillator. The lamp driver/oscillator includes a transformer with at least one primary winding and a secondary winding for each output line. The oscillator circuit is configured to stagger the cyclical power application to the electrodes so that the gas in the lamp tube remains energized at all times. Any number of electrodes and phase lines may be used and as the number is increased the drop in ionization between gas ionization peaks is reduced.

The present invention further contemplates that multi-phase gas discharge lamps may be configured in any structurally supportable geometric configuration including substantially planar structures wherein the gas is confined between two glass plates having a desired two-dimensional plan-form and both regular and irregular three-dimensional shapes. Regular three-dimensional shapes may include, for example, hollow spheroids and regular polyhedrons. Irregular shapes may include virtually any three-dimensional structure formed from planar and curved walls that define a gas space therebetween.

FIG. 1 is a schematic representation of a multi-phase gas discharge lamp 100 according to an embodiment of the invention. As shown, the lamp 100 is a three phase lamp comprising three electrodes 102, 104, 106, configured for energizing a gas such as argon or xenon within the lamp 100 and forming plasma paths therein. Each electrode is connected to one of three output lines 31, 32, 33 of a multi-phase AC power source 30 through a series capacitor 11, 12, 13. Each output line 31, 32, 33 provides an AC current to its associated electrode that is 360/3=120 degrees out of phase with each of the other two electrodes. This produces the effect that the reduction in energy level of the plasma in the lamp 100 during a given cycle is reduced and enhances the efficiency of the lamp.

It will be understood by those of ordinary skill in the art that the AC power source 30 may be any power source suitable for providing three phase AC power. In a preferred embodiment, the AC power source incorporates a multi-phase transformer having a plurality of transformer blocks capable of providing high frequency sinusoidal current to the electrodes 102, 104, 106. A preferred multi-phase transformer that may be used in conjunction with the lamps of the present invention is disclosed in provisional patent application No. 60/460,336, which is incorporated herein by reference in its entirety.

Figure 2:
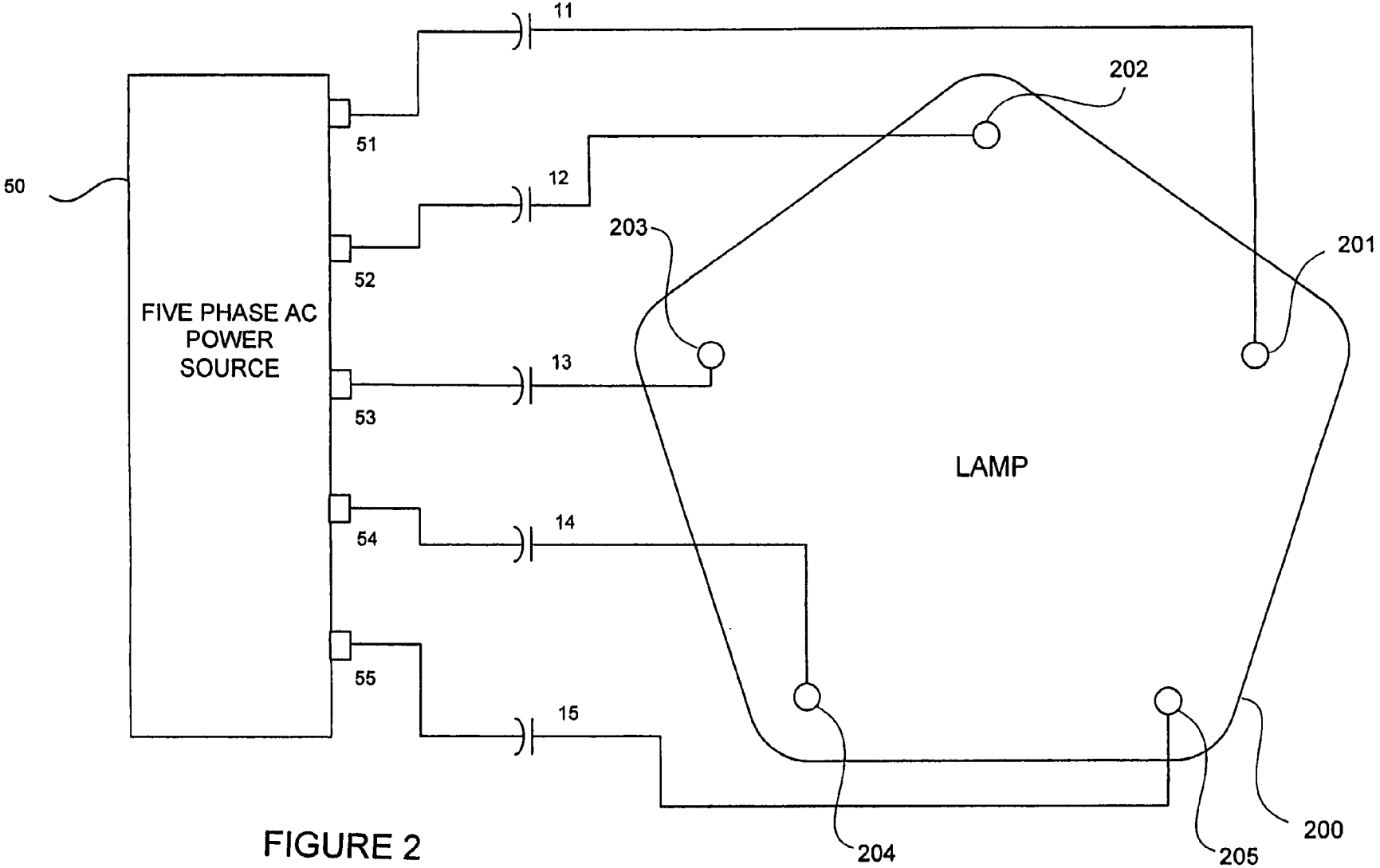
FIG. 2 is a schematic representation of a multi-phase gas discharge lamp system according to an embodiment of the present invention.

Lamps according to the present invention may be configured to operate with any number of shifted phase inputs. FIG. 2, for example, is a schematic representation of a multi-phase gas discharge lamp 200 according to an embodiment of the invention, wherein the lamp 200 is a five phase lamp comprising five electrodes 201, 202, 203, 204, 205 configured for energizing a gas such as argon or xenon within the lamp 200 and forming plasma paths therein. Each electrode is connected to one of five output lines 51, 52, 53, 54, 55 of a multi-phase AC power source 50 through a series capacitor 11, 12, 13, 14, 15. Each output line 51, 52, 53, 54, 55 provides an AC current to its associated electrode that is incrementally shifted by 360/5=72 degrees out of phase with adjacent electrodes.

It will be understood by those of ordinary skill in the art that the lighting efficiency of the lamps of the present invention increases with the number of electrodes and associated phase shifted inputs. Any number of electrodes and associated phase shifted AC inputs may be used but the marginal performance enhancement will decrease as the ideal efficiency level is approached.

Figure 3:
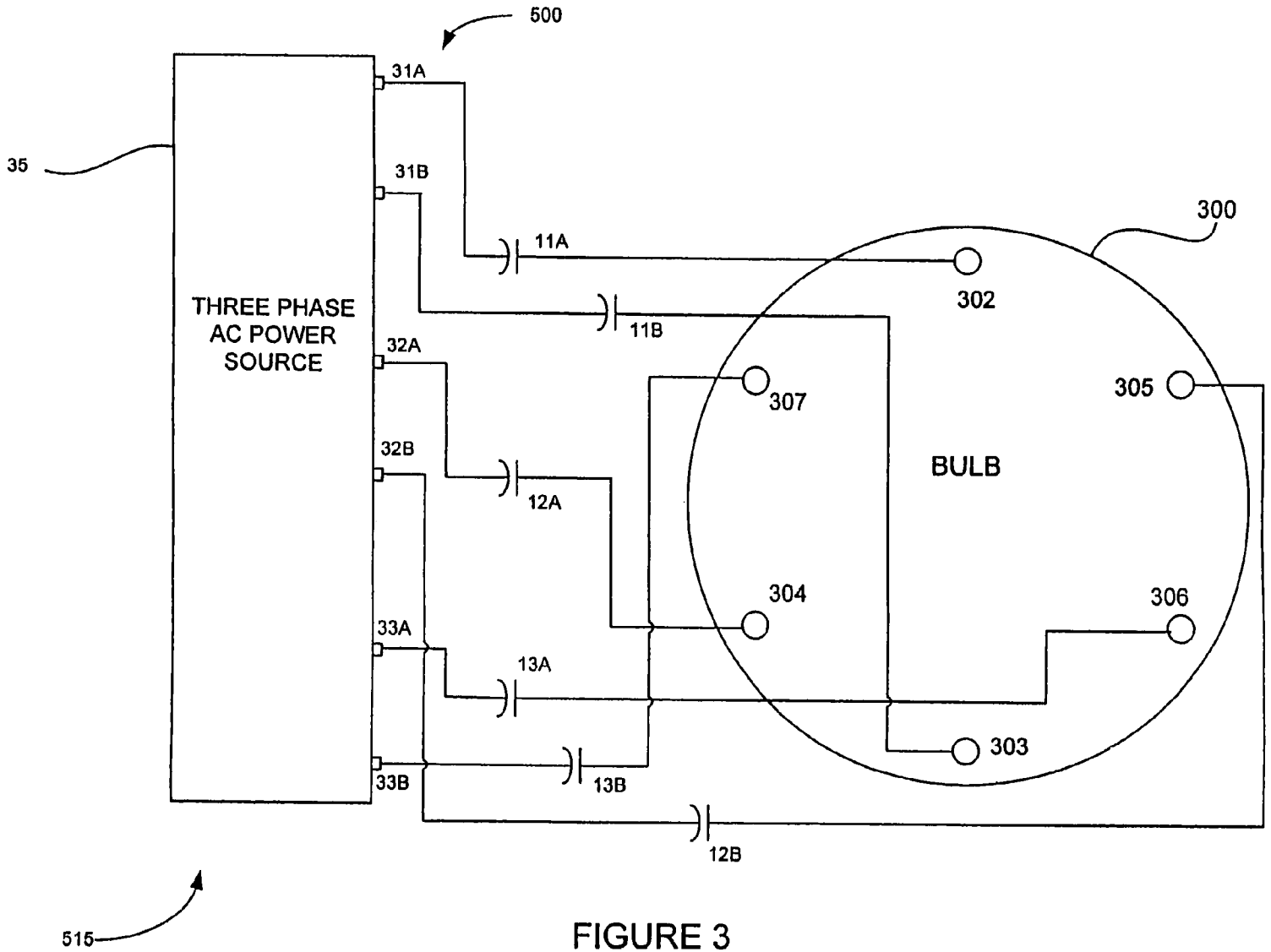
FIG. 3 is a schematic representation of a multi-phase gas discharge lamp system according to an embodiment of the present invention.

As discussed in provisional application No. 60/460,336, certain multi-phase AC power sources may incorporate transformers having center-tapped secondary windings. Such transformers may have dual output lines for each phase of output. FIG. 3 is a schematic representation of an embodiment according to the invention, wherein a lamp 300 comprising six electrodes 301, 302, 303, 304, 305, 306 is adapted for connection to a three phase AC power source 35 having six output leads 31A, 31B. 32A, 32B, 33A, 33B. Two output leads 31A, 31B provide AC current at a first phase, two output leads 32A, 32B provide AC current at a second phase and two output leads 33A, 33B provide current at a third phase. The input lines 31A, 31B. 32A, 32B, 33A, 33B are paired with electrodes 301, 302, 303, 304, 305, 306 in such a way as to maximize the efficiency with which the system maintains the energy level in the plasma.

Figure 4:
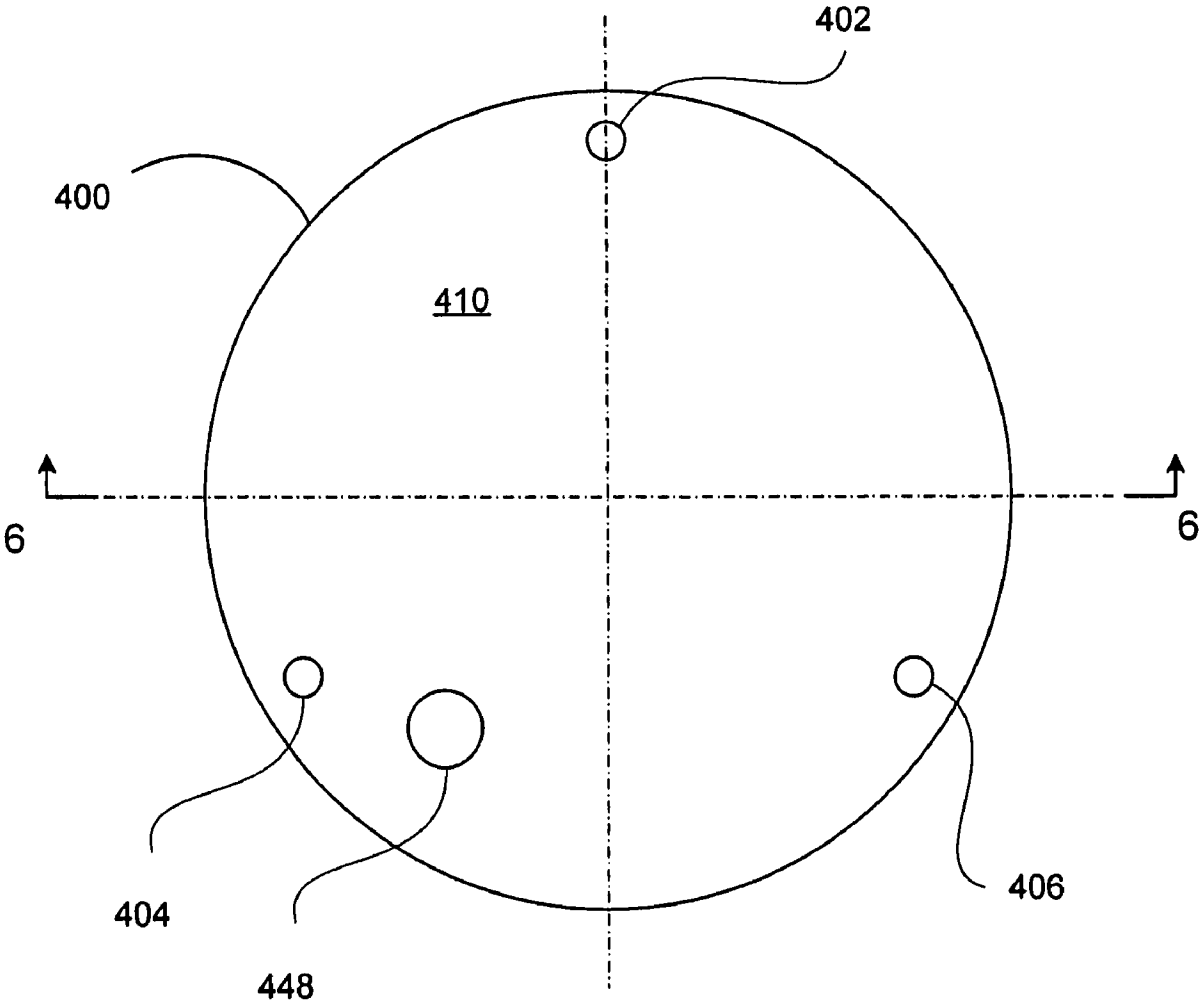
FIG. 4 is a top view of a multi-phase gas discharge lamp according to an embodiment of the present invention.
Figure 5:
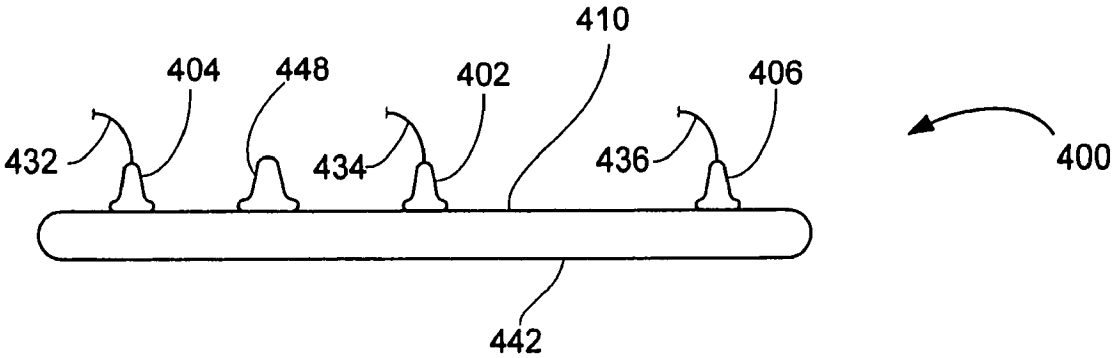
FIG. 5 is a side view of the multi-phase gas discharge lamp of FIG. 4.
Figure 6:
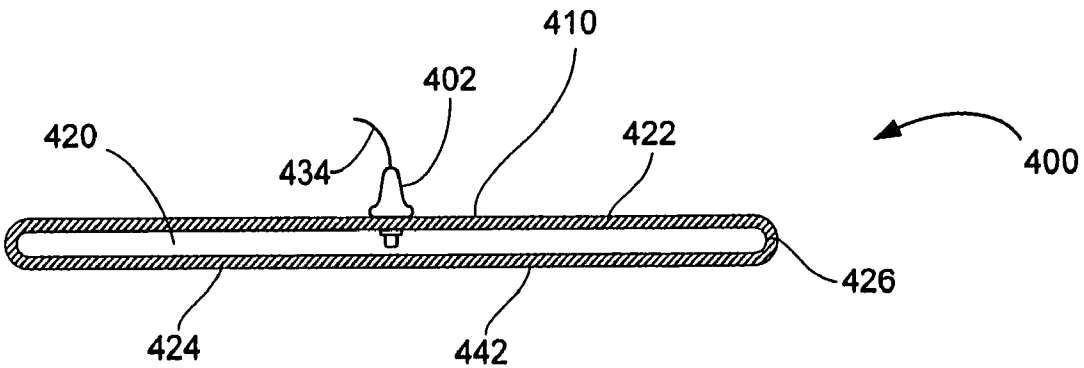
FIG. 6 is a cross-sectional view of the multi-phase gas discharge lamp of FIG. 4.

The gas discharge lamps of the present invention may be constructed in a wide variety of configurations. FIGS. 4–6 illustrate an embodiment of the invention that includes a substantially disk-shaped gas discharge lamp 400. The gas discharge lamp 400 comprises a bulb having an upper wall 422, a lower wall 424 and a rim wall 426 that combine to define an interior space 420. A plasma-forming gas such as argon, xenon or combinations is disposed in the interior space 420. The upper wall 422 includes apertures formed therein for the insertion of three electrodes 432, 434, 436. The three electrodes 432, 434, 436 are similar or identical to those known in the art for energizing and lighting gas discharge lamps. The electrodes include electrical lead connectors for use in connecting the electrodes to an AC power source. Another aperture 418 formed in the upper wall 422 may be used to establish a vacuum in the interior chamber 420 and/or insert gas therein.

The electrode apertures are placed so as to establish a substantially uniform plasma distribution, both spatially and temporally.

As shown in FIG. 4, the lamp 400 has a substantially circular planform. As will be discussed in more detail hereafter, lamps according to the present invention may be configured with any symmetric or asymmetric planform shape. The diameter (or overall lateral extension of non-circular plan-forms) is unlimited and the thickness of the walls 422, 424, 426 are determined by the structural requirements to maintain a vacuum and support the lamp structure. In an exemplary embodiment, the outside diameter of the circular lamp 400 may be approximately 8.0 inches with the walls being about 0.250 in. thick and the upper and lower walls being parallel and about 0.125 in. apart. The gap between walls may vary according to specific usage but will generally be between about 0.01 in. and about 6 in.

The walls 422, 424, 426 are typically transparent or translucent glass in order to transmit light from the lamp. At least a portion of the interior surfaces of the walls 422, 424, 426 may be coated with phosphors to convert ultraviolet light from the energized plasma into visible light. A predetermined light color may be established using techniques that are known in the art.

The lamp 400 may incorporate a mirror on some or all of the upper surface 410 of the upper wall 422. The mirror may be formed as a separate member or layer attached to the upper surface 410 or may be a coating applied directly to the upper surface 410. The mirror would serve to enhance the brightness of the light emitted through the lower surface 412 of the lamp 400.

In the illustrated lamp 400, the rim wall 126 is shown as being substantially curved, concave relative to the lamp interior space, and integrally formed with the upper and lower walls, 422, 424. Other embodiments of the invention may have rim walls that are formed as separate members that are attached to the upper and lower walls by methods known in the art such as bonding. Further, the rim wall cross-section may be straight or even concave.

Figure 7:
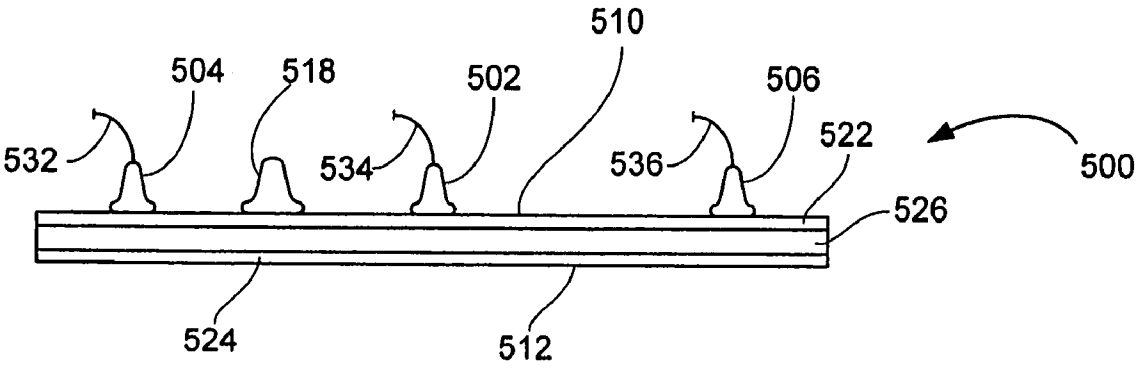
FIG. 7 is a side view of a multi-phase gas discharge lamp according to an embodiment of the present invention.
Figure 8:
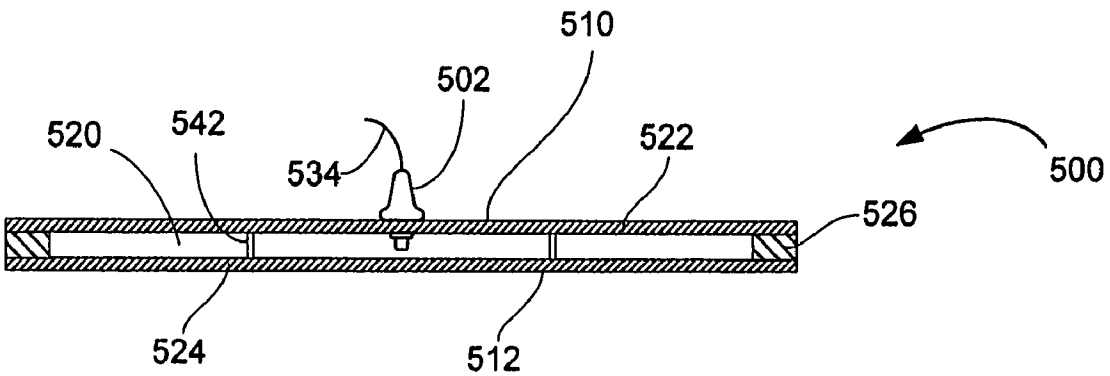
FIG. 8 is a cross-sectional view of the multi-phase gas discharge lamp of FIG. 7.

FIGS. 7 and 8 illustrate an embodiment of the present invention, wherein a gas discharge lamp 500 is formed from parallel upper and lower walls 222, 224 joined by an annular ring 526 that serves as a rim wall of the substantially planar lamp 500. In other respects, the lamp 500 is substantially similar to the lamp 400 of FIGS. 4–6 in that it includes three electrodes 532, 534, 536 disposed in apertures through the upper wall 522. The electrodes 532, 534, 536 are distributed as in the previous embodiment.

As shown in FIG. 8, gas discharge lamps according to the present invention may incorporate supports 542 between the upper and lower walls to strengthen the structure of the lamp. The supports 542 may be formed from glass and bonded to the upper and lower walls 522, 524.

Figure 9:
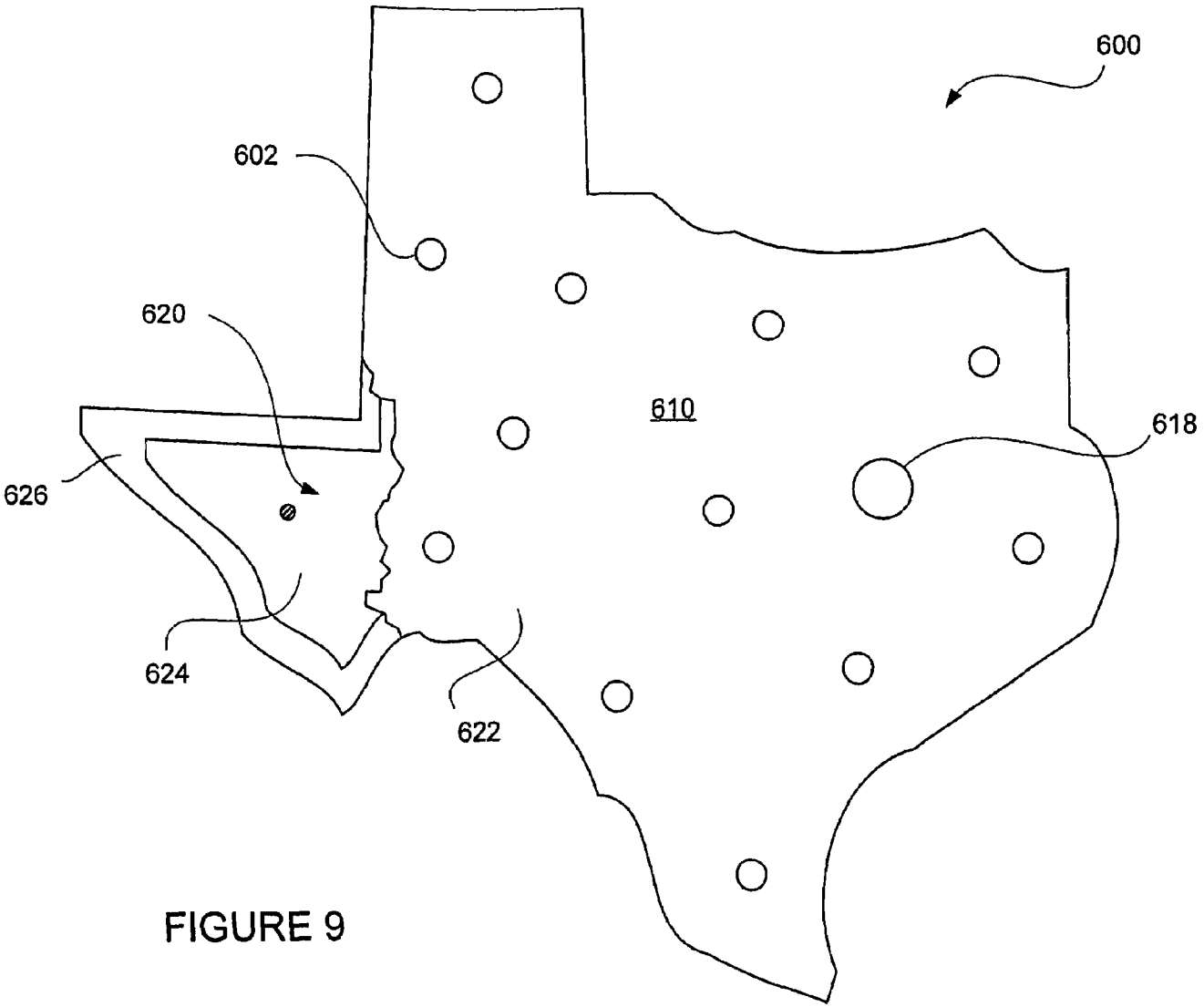
FIG. 9 is a top view of a multi-phase gas discharge lamp according to an embodiment of the present invention.

FIG. 9 illustrates an embodiment according to the invention, wherein a gas discharge lamp 600 is formed from parallel upper and lower walls 622, 624 joined by an annular perimeter member 626 to define a single interior space 620. The lamp 600 has a large non-uniform plan-form and has thirteen electrodes 602 arranged to provide a substantially uniform field within the interior 620 of the lamp 600. The thirteen electrodes 602 may be connected to a single multi-phase AC power source or to a plurality of power sources. A single-phase AC power source may be adapted to provide a separate phase of AC current to each electrode 602.

Figure 10:
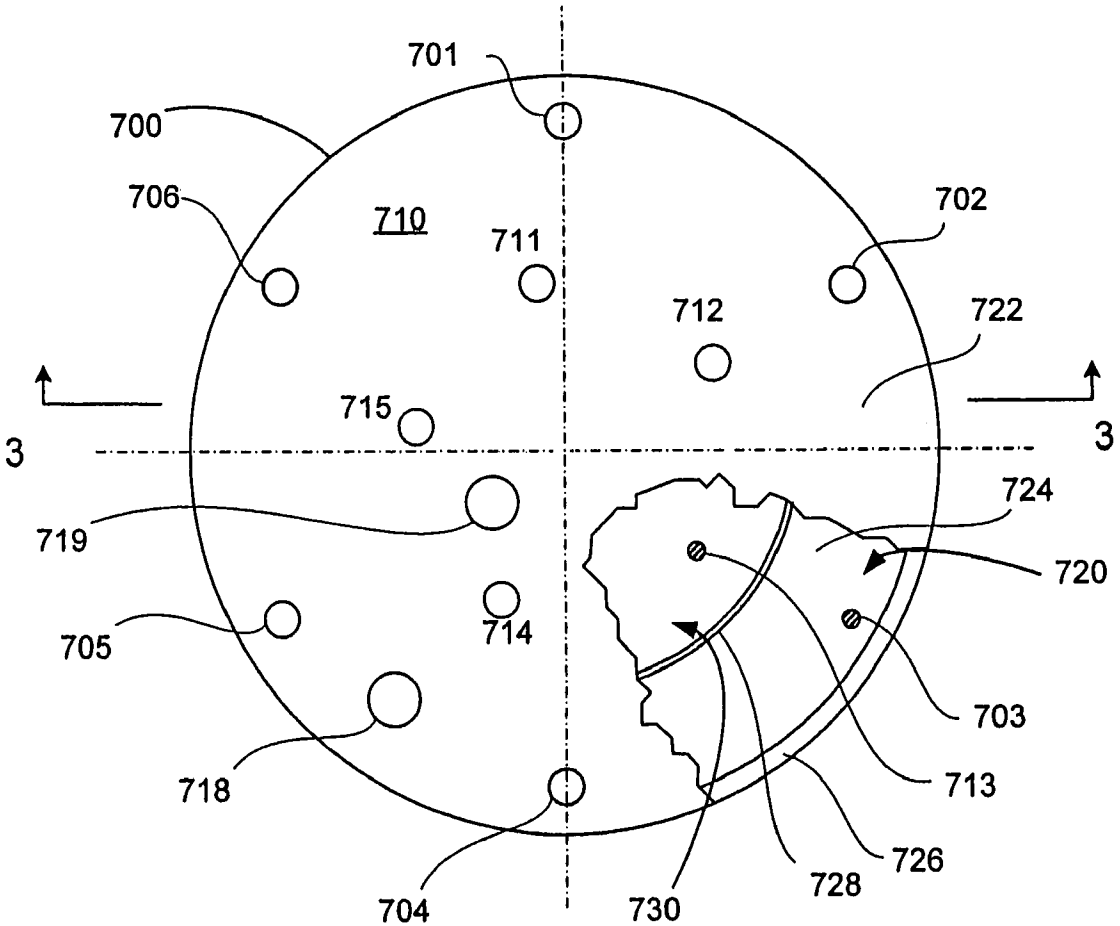
FIG. 10 is a top view of a multi-phase gas discharge lamp according to an embodiment of the present invention.
Figure 11:
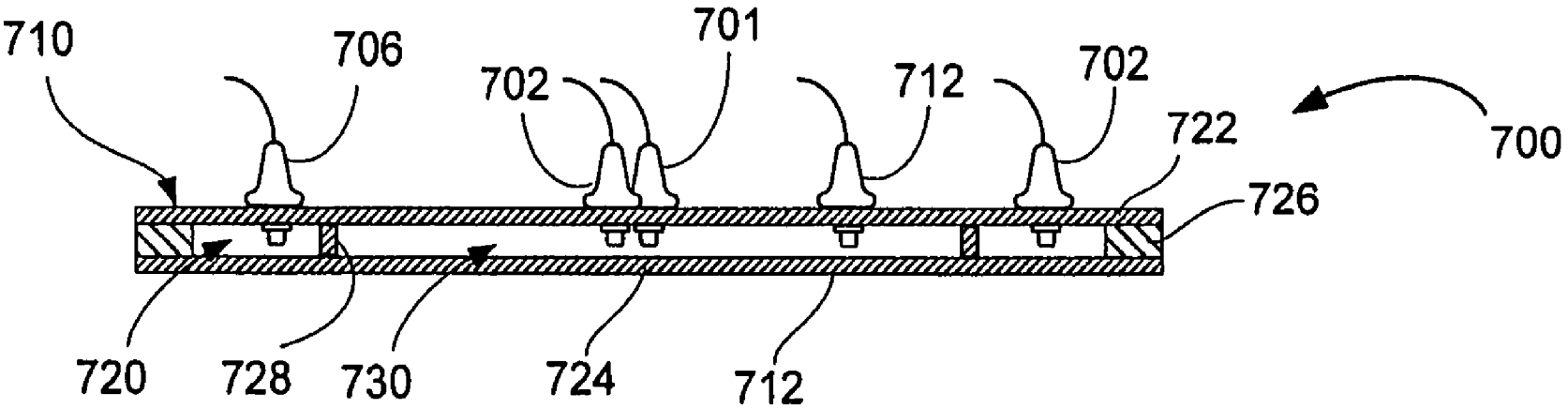
FIG. 11 is a cross-sectional view of the multi-phase gas discharge lamp of FIG. 10.

The present invention contemplates multi-electrode lamps comprising more than one lamp chamber which may be lit by independent sets of electrodes. FIGS. 10 and 11 illustrate an exemplary embodiment according to the invention, wherein a gas discharge lamp 700 is formed from parallel upper and lower walls 722, 724 joined by an outer annular ring 726 and an inner annular ring 728. These walls 722, 724, 726, 728 define an inner lamp chamber 730 and an outer lamp chamber 720. The lamp comprises an inner electrode set with five electrodes 711, 712, 713, 714, 715 and an outer electrode set with six electrodes 701, 702, 703, 704, 705, 706. The inner and outer lamp chambers 720, 730 may also include separate vacuum ports 718, 719 disposed through upper wall 722. The inner and outer electrode sets may be powered by separate multi-phase transformers or by a single multi-phase transformer.

It will be understood by those of ordinary skill in the art that any of the lamps of the invention may be subdivided into multiple lamp chambers, which may be independently powered and lit using any number of electrodes. The individual chambers may be filled with different materials in order to produce light of different colors.

Figure 12:
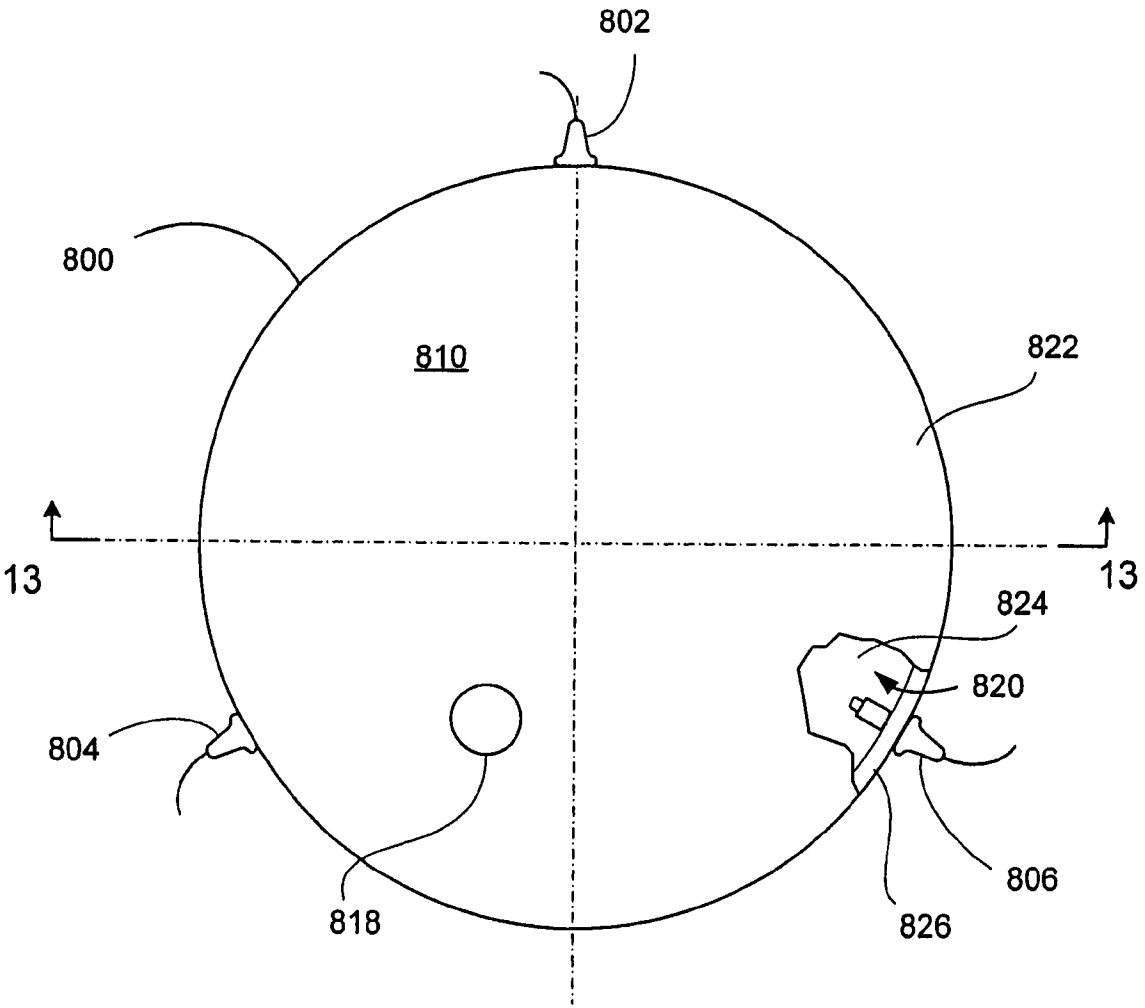
FIG. 12 is a top view of a multi-phase gas discharge lamp according to an embodiment of the present invention.
Figure 13:
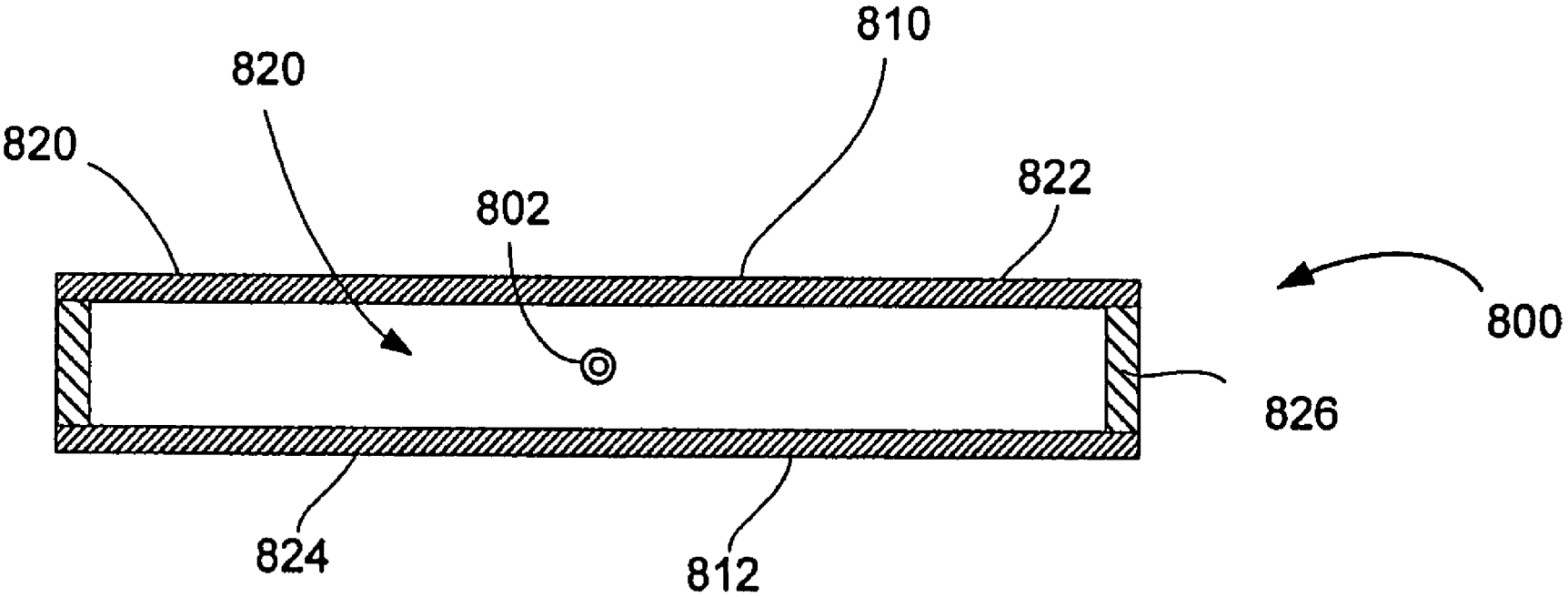
FIG. 13 is a cross-sectional view of the multi-phase gas discharge lamp of FIG. 12.

FIG. 12 illustrates an embodiment of a gas discharge lamp 800 having parallel upper and lower walls 822, 824 joined by an annular perimeter wall 826, which combine to define an interior chamber 820. The lamp 800 includes three electrodes 802, 804, 806 that are disposed in apertures formed in the perimeter wall 826 so that they extend into the interior chamber 820. As in previous embodiments, the electrodes 802, 804, 806 are configured to selectively energize the gas inside the interior chamber 820 to form plasma paths therein. Any number of electrodes may be used and each may be driven using a different phase AC current input. The electrodes may all be driven by a single multi-phase AC power source. The perimeter electrode configuration may be used in conjunction with other previously described features of the invention such as a mirrored upper surface and multiple lamp chambers.

Figure 14:
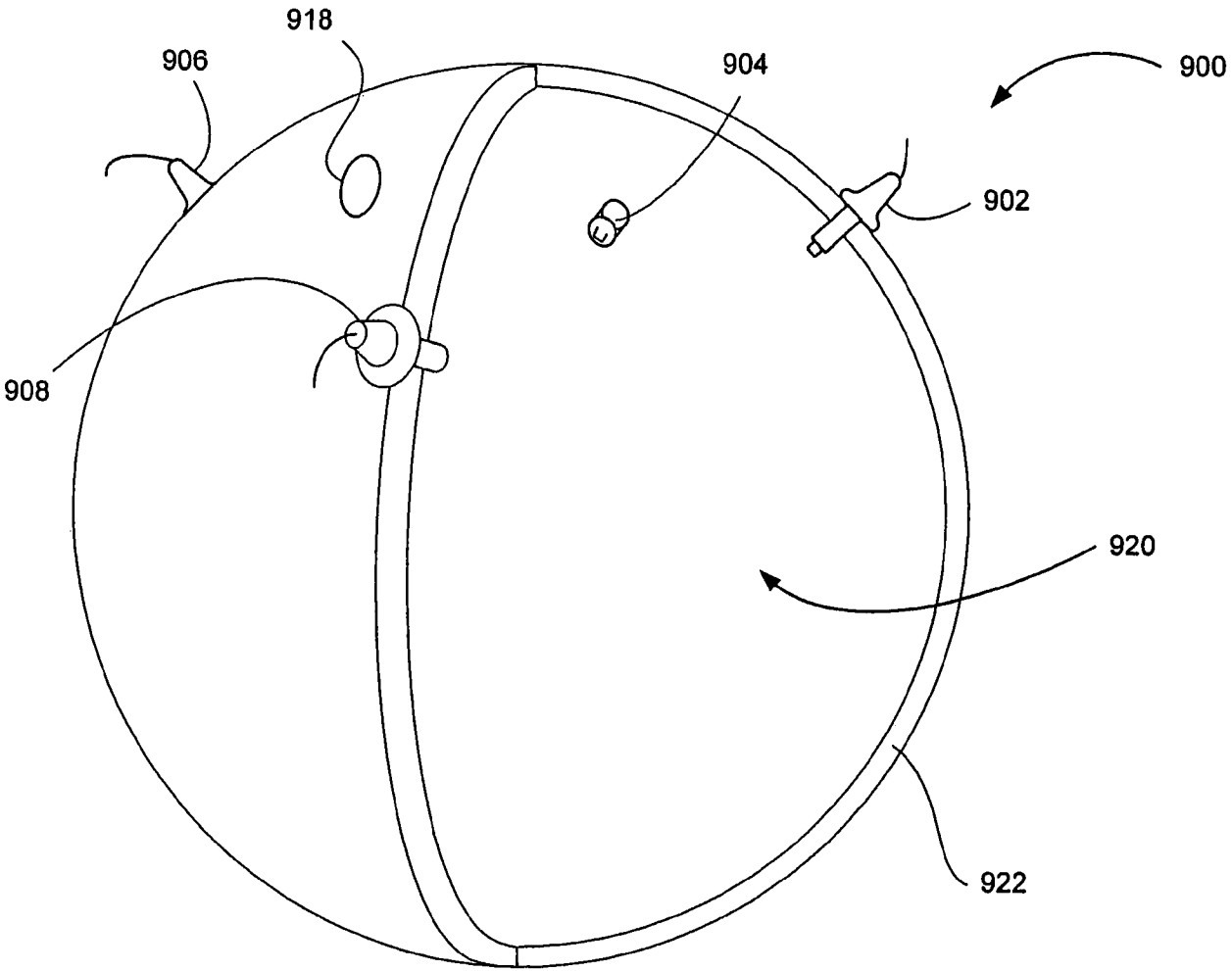
FIG. 14 is a cutaway perspective view of a multi-phase gas discharge lamp according to an embodiment of the present invention.

Heretofore, the discussed embodiments have related to lamps wherein the lamp chamber is formed between parallel plates and the tips of the electrodes are substantially coplanar. The invention is not, however, confined to these two dimensional configurations. FIG. 14 illustrates a gas discharge lamp 900 formed as a sphere having a substantially uniform wall 922 defining a spherical interior chamber 920. The wall 922 is preferable formed from transparent or translucent glass and the interior chamber may be filled with any plasma-forming gas such as argon or xenon. Phosphors may be coated on all or part of the interior surface of the wall 922. The thickness of the wall 922 would be determined by the size of the lamp. If necessary, structural supports may be positioned within the interior chamber. The wall 922 may be formed as a single monolithic structure or may be formed from subsections such as, for example, two hemispherical members bonded together.

The wall 922 has four apertures formed therethrough in which electrodes 902, 904, 906, 908 are positioned. The electrodes 902, 904, 906, 908 are configured to energize the gas within the interior chamber to form plasma paths therein. As in other embodiments of the invention, the four electrodes 902, 904, 906, 908 may be driven by a single multi-phase AC power source, with each electrode receiving a different phase AC input to minimize de-energization of the plasma in a given cycle.

Embodiments of a spherical lamp of this type may, of course, use any number of electrodes and each electrode may be supplied by a different phase of AC current.

Three dimensional lamps according to the present invention may be of any regular including other spheroids (e.g., a football shape) and regular polyhedrons such as for example a pyramid. Irregular shapes may include virtually any three-dimensional structure formed from planar and curved walls that define a gas space therebetween. Any three dimensional embodiment of the present invention may also include previously described features such as mirrored or partially mirrored surfaces and multiple inner chambers with independently powered sets of electrodes.

It has been found that enhanced efficiency may be obtained in three dimensional lamps by decreasing the volume of gas that must be energized at a fixed power input.

Figure 15:
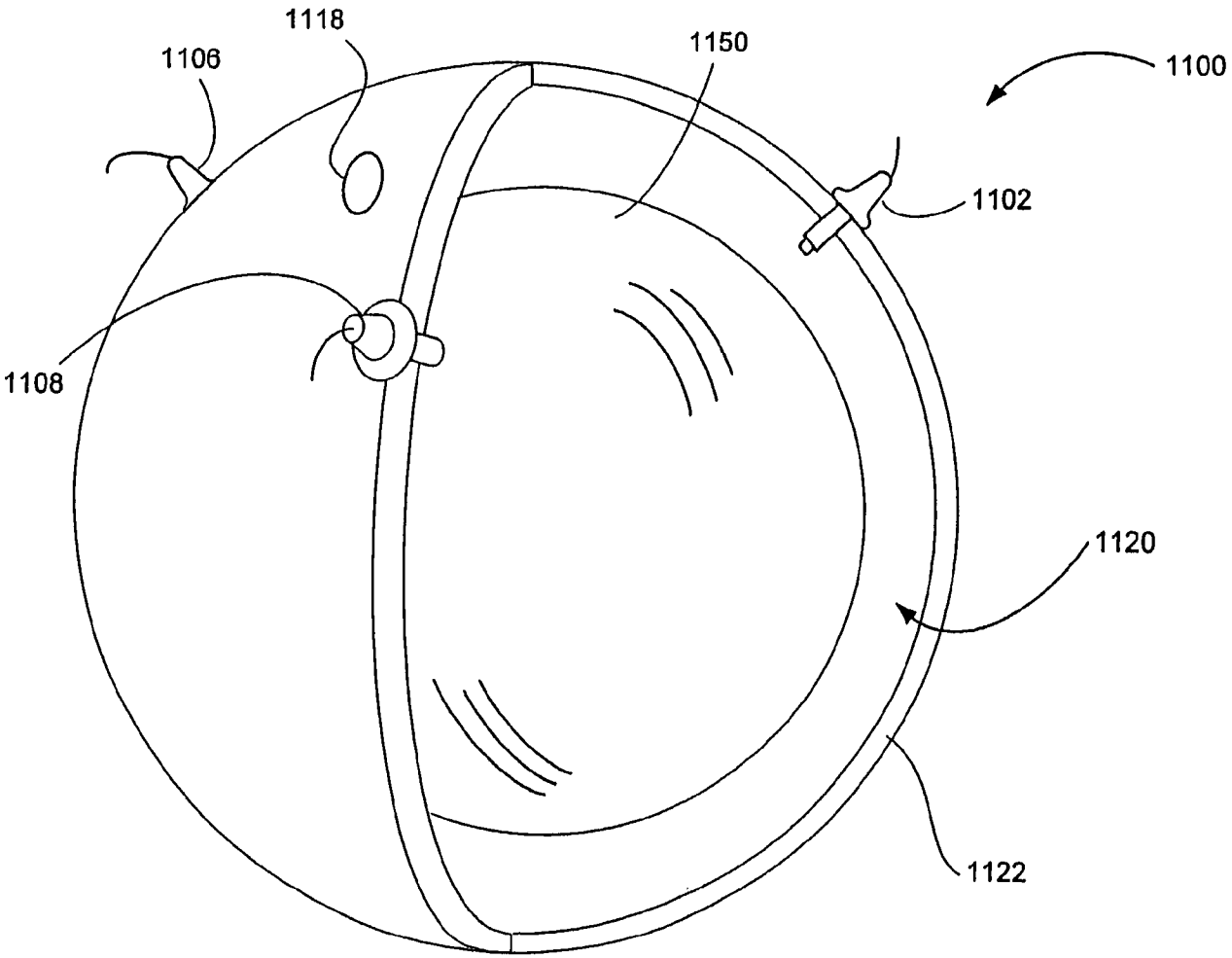
FIG. 15 is a cutaway perspective view of a multi-phase gas discharge lamp according to an embodiment of the present invention.

This may be accomplished by positioning an inner structure within the outer shell of the lamp. An exemplary embodiment of this type is shown in FIG. 15. FIG. 15 illustrates a gas discharge lamp 1100 according to the invention that, like the previous embodiment, includes a spherical outer wall defining a lamp chamber 1120. Like the previous embodiment, the lamp 1100 includes four electrodes disposed through the wall 1122 for energizing the gas within the interior chamber 1120. In this embodiment, however, a spherical inner structure 1150 having an outer diameter smaller than the inner diameter of the wall 1122 is positioned within the interior chamber of the lamp 1100. The inner structure is preferably co-centered with the spherical outer wall 1122. The inner structure serves to reduce the volume of gas that must be energized in order to maintain the plasma in an excited state.

Similar inner structures may be established for virtually any three dimensional shape.

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

It should be emphasized that the terms "comprises", "comprising", "includes", and "including", when used in this description and claims, are taken to specify the presence of stated features, steps, or components, but the use of these terms does not preclude the presence or addition of one or more other features, steps, components, or groups thereof.

What is claimed is:

1. A multi-phase gas discharge lamp, comprising an interior space defined by at least one wall and divided into a plurality of chambers;

a plasma-forming gas disposed in the interior space;

a plurality of electrodes positioned within each of said plurality of chambers, with at least three electrodes positioned in one of said chambers; and a multi-phase AC power source that provides a different phase of power to different respective ones of the electrodes in each chamber to energize the plasma-forming gas.

2. The multi-phase gas discharge lamp of claim 1, wherein the interior space is defined by an upper wall, a lower wall, and a rim wall.

3. The multi-phase gas discharge lamp of claim 2, wherein the rim wall is concave relative to the lamp interior space and integrally formed with the upper and lower walls.

4. The multi-phase gas discharge lamp of claim 2, wherein the upper and lower walls are parallel and joined by an annular ring shaped rim wall.

5. The multi-phase gas discharge lamp of claim 2, comprising supports between the upper and lower walls.

6. The multi-phase gas discharge lamp of claim 2, wherein the electrodes are disposed in apertures formed in the rim wall.

7. The multi-phase gas discharge lamp of claim 1, wherein the interior space is defined by a spherical wall.

8. The multi-phase gas discharge lamp of claim 1, wherein the electrodes are positioned to establish a substantially uniform plasma distribution, both spatially and temporally, within the interior space when the plasma-forming gas is energized.

9. The multi-phase gas discharge lamp of claim 1, wherein at least a portion of interior surfaces of the walls is coated with phosphors to convert ultraviolet light from the energized plasma-forming gas into visible light.

10. The multi-phase gas discharge lamp of claim 1, wherein at least a portion of interior surfaces of the walls include a reflective material.

11. The multi-phase gas discharge lamp of claim 1, wherein the individual chambers are filled with different mixtures of plasma-forming gases.

12. The multi-phase gas discharge lamp of claim 1, wherein the at least one wall defines one of an interior space of regular spheroids and regular polyhedrons.

13. The multi-phase gas discharge lamp of claim 1, comprising a spherical outer wall defining a lamp chamber and a spherical inner structure having an outer diameter smaller than an inner diameter of the spherical outer wall and positioned within the interior space of the lamp.

14. The multi-phase gas discharge lamp of claim 1, wherein the plasma-forming gas comprises at least one of argon and xenon.

* * * * *